US009028305B2

(12) United States Patent
Nogin et al.

(10) Patent No.: US 9,028,305 B2
(45) Date of Patent: May 12, 2015

(54) COIN CHANGER WITH COIN STORAGE CASSETTE HAVING ILLUMINATION AND AUDIBLE AND VISUAL FEEDBACK SIGNALS

(75) Inventors: Michael A. Nogin, Creve Coeur, MO (US); Richard H. Sorgea, Brentwood, MO (US); Ian F. Murphy, Crestwood, MO (US); Thomas S. Paczkowski, Wildwood, MO (US)

(73) Assignee: Coin Acceptors, Inc., St. Louis, MO (US)

( * ) Notice: Subject to any disclaimer, the term of this patent is extended or adjusted under 35 U.S.C. 154(b) by 13 days.

(21) Appl. No.: 11/775,673

(22) Filed: Jul. 10, 2007

(65) Prior Publication Data

US 2008/0142335 A1 Jun. 19, 2008

Related U.S. Application Data

(60) Provisional application No. 60/806,894, filed on Jul. 10, 2006, provisional application No. 60/889,698, filed on Feb. 13, 2007.

(51) Int. Cl.

| | |
|---|---|
| ***G07D 13/00*** | (2006.01) |
| ***G07D 1/00*** | (2006.01) |
| ***G07F 9/02*** | (2006.01) |

(52) U.S. Cl.

CPC ... *G07F 9/02* (2013.01); *G07D 1/00* (2013.01)

(58) Field of Classification Search

USPC ..... 453/16, 58, 63; 362/362, 375

See application file for complete search history.

(56) References Cited

U.S. PATENT DOCUMENTS

| | | | | |
|---|---|---|---|---|
| 4,369,442 | A | 1/1983 | Werth et al. | |
| 4,413,718 | A * | 11/1983 | Dean | 194/344 |
| 4,475,222 | A * | 10/1984 | Egendorf | 377/15 |
| 4,731,819 | A * | 3/1988 | Kalfon | 379/145 |
| 5,501,633 | A | 3/1996 | Watkins et al. | |
| 5,733,186 | A | 3/1998 | Leibu | |
| 5,947,257 | A * | 9/1999 | Schwartz | 194/224 |
| 6,021,883 | A * | 2/2000 | Casanova et al. | 194/217 |
| 7,147,551 | B2 * | 12/2006 | Meyer-Weingaertner | 453/16 |
| 2002/0168931 | A1 * | 11/2002 | Nakajmima et al. | 453/3 |
| 2004/0097181 | A1 * | 5/2004 | Perkitny | 453/3 |

OTHER PUBLICATIONS

PCT/US2007/073162 Notification of Transmittal of the International Search Report and the Written Opinion of the International Searching Authority or the Declaration (3 pages), (Jul. 10, 2007).

PCT/US2007/013162 Written Opinion of the International Searching Authority (4 pages), (Jul. 10, 2007).

PCT/US2007/013162 International Search Report (3 pages), (Jul. 10, 2007).

* cited by examiner

*Primary Examiner* — Mark Beauchaine

(74) *Attorney, Agent, or Firm* — Polster Lieder

(57) ABSTRACT

A coin changer including a coin changer housing comprising a coin storage cassette. The coin storage cassette comprises a plurality of coin stores. A light source is located within the housing that directs light onto the coin stores with the light source providing sufficient light to allow a user to substantially view the coin stores in the absence of another light source.

18 Claims, 8 Drawing Sheets

FIG. 8

Warning Messages

| Display | Definition |
|---|---|
| Tube Cassette Not Defined | The changer has an unknown cassette or tube configuration and cannot route coins. Please see Figure XX to correct. |
| Validation Error | There is a problem in the validation area and it should be checked. Most likely it should be cleaned. |
| Acceptor Jam | There is a jam in the acceptor or sorting area that needs to be cleared. |
| Escrow Detected | The escrow lever is depressed enough to open the acceptor gate. Please check the installation or clear a possible acceptor jam. |
| Sort Door Open | The sorting cover door should be closed for proper operation. |
| Cassette Door Open | The payout cassette shoud be closed.. |
| Payout Jam Tube X | The noted tube has a coin jammed. |
| Disabled by VMC | The changer lost communication with the vending machine controller. |

Out Of Service Messages

| | |
|---|---|
| Out-of-Service Communication | The changer has a serious communication error and is non-operational. *Please take it to a Coinco authorized Service Center immediately.* |
| Out-of-Service Tube Sense | The changer has a tube sense error and is non-operational. *Please take it to a Coinco authorized Service Center immediately.* |

COIN CHANGER WITH COIN STORAGE CASSETTE HAVING ILLUMINATION AND AUDIBLE AND VISUAL FEEDBACK SIGNALS

The present application claims priority to U.S. Provisional Patent Application Ser. No. 60/806,894, filed Jul. 10, 2006, and to U.S. Provisional Patent Application Ser. No. 60/889,698, filed Feb. 13, 2007. The contents of such applications are incorporated herein by reference.

FIELD OF THE DISCLOSURE

The field of the invention relates generally to coin changer and validation devices.

BACKGROUND OF THE INVENTION

Ease of use of coin changers is important. From the perspective of a consumer using a coin changer, a coin changer should be able to precisely identify valid coins and should be configured to have plenty of change on hand to pay out in acceptable denominations and without error.

From the perspective of the owner of a device in which the coin changer is installed, such as a vending machine, ease of use is a different subset of features but is equally important. Any features which improve the ownership experience makes the product more desirable. Features which make coin changer easier or quicker to service works to lower ownership costs and maximize profits. Therefore, there is a need in the art for features for coin changers that make such devices easier or quicker to service.

SUMMARY OF THE INVENTION

The present invention provides, in one aspect, a coin changer including a coin changer housing comprising a coin storage cassette. The coin storage cassette comprises a plurality of coin stores. A light source is located within the housing that directs light onto the coin stores with the light source provides sufficient light to allow a user to substantially view the coin stores in the absence of another light source.

BRIEF DESCRIPTION OF THE DRAWINGS

Referring now to the drawings in which like reference numbers represent corresponding parts throughout:

FIG. 8 is a table showing "warning" and "out of service" messages that are displayed on the display portion of the keypad-display module according to an embodiment of the present invention.

DETAILED DESCRIPTION OF PREFERRED EMBODIMENT

In the following description, reference is made to the accompanying drawings which form a part hereof, and which is shown, by way of illustration, an embodiment of the present invention. It is understood that other embodiments may be utilized and structural changes may be made without departing from the scope of the present invention.

The preferred embodiment of the present invention discloses apparatus for an operator of a coin changer having a removable cassette to easily load or to modify the coin store types when there is insufficient lighting. A light source illuminates the coin stores when the cassette is moved out of its dispensing position for hand loading or for making changes to the coin stores. Other sound and light effects are available to the operator to make sure that the set up was complete.

Throughout this application the term "user" is defined to be an owner of a device that includes a coin changer, such as a vending machine. "User" also encompasses the owner's agents or employees or anyone else acting to service or otherwise resupply the device that includes the coin changer. The term "user" is to be interpreted broadly, but it specifically excludes anyone whose primary or sole purpose is to insert money into the machine as payment for products or services.

Figure 1:
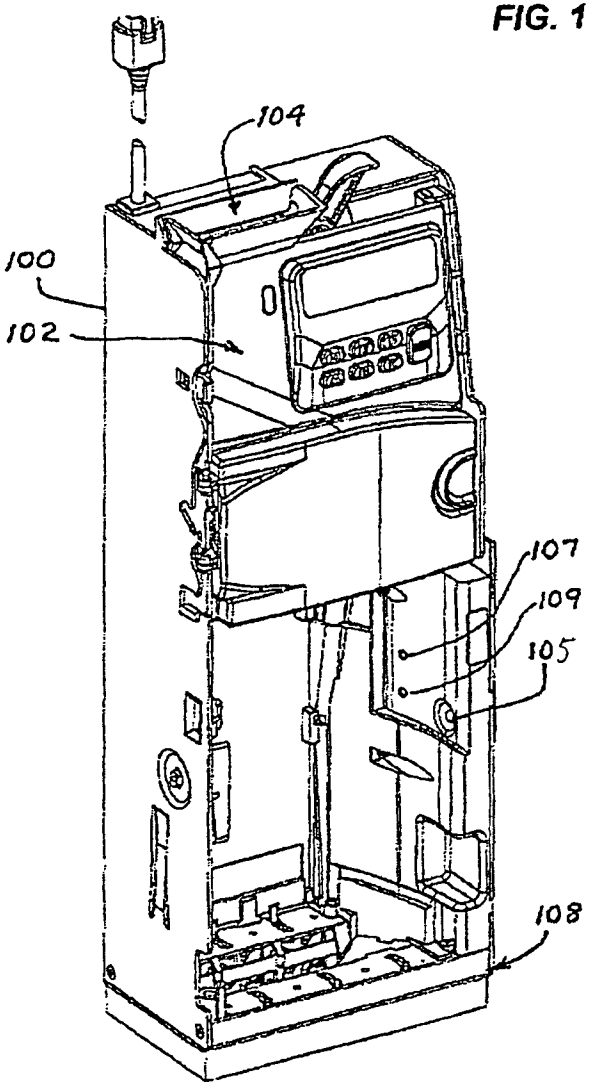
FIG. 1 is a perspective view of a coin changer excluding its cassette according to an embodiment of the present invention.

Referring to FIG. 1, there is shown a perspective view of the coin changer housing 100 with its coin acceptor 102, a coin intake funnel 104, a light source 105 and its payout base 108. An aperture 107 is used to send an infrared beam out to the cassette (106 in FIG. 2) and, when the cassette is in position, provides a return path through an aperture 109 to a photo sensor. In normal operation, the cassette 106 is inserted into the area above the payout base 108, in an operating position.

Figure 2:
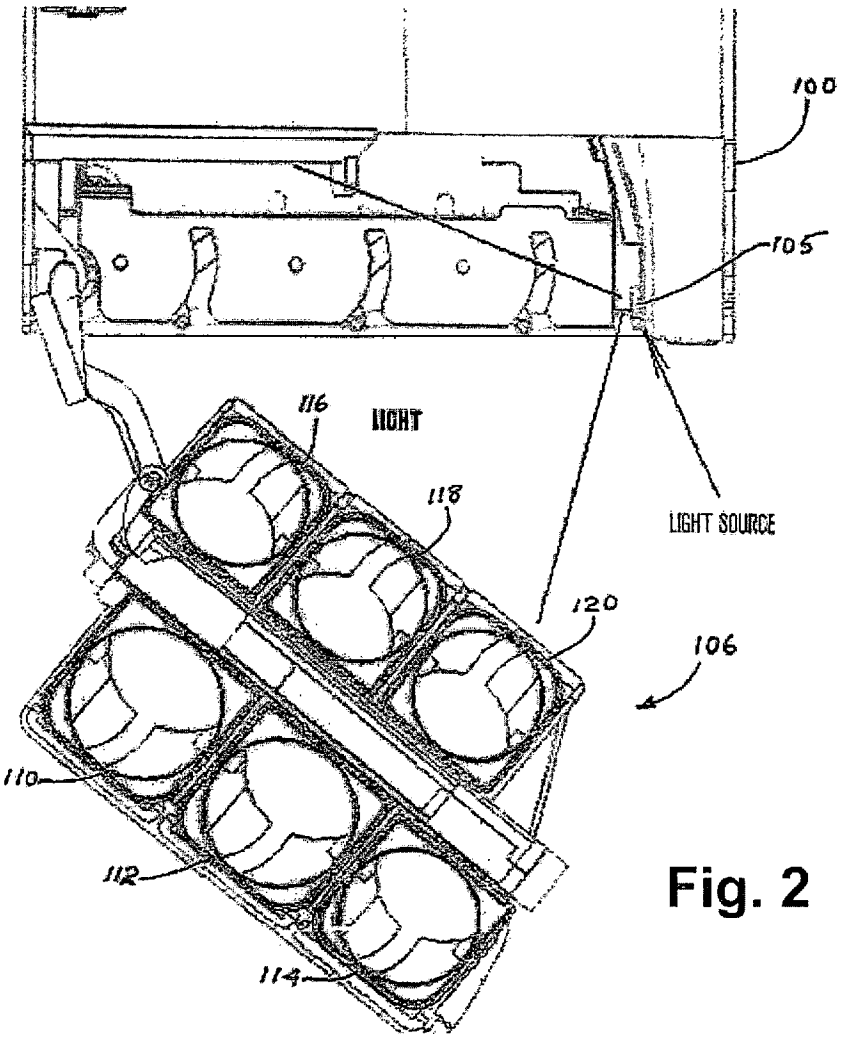
FIG. 2 is a top view of a coin changer with a cassette rotated away from a coin changer housing according to an embodiment of the present invention.

In FIG. 2, the coin changer housing 100 is attached to the coin cassette 106. In FIG. 2, the coin cassette 106 is shown rotated away from the housing 100 on two hinges 109. The coin cassette 106 comprises six coin stores 110, 112, 114, 116, 118, and 120. The light source 105 illuminates the coin stores, which in the most preferred embodiment are clear tubes, when the cassette 106 is moved out of its operating position.

Figure 3:
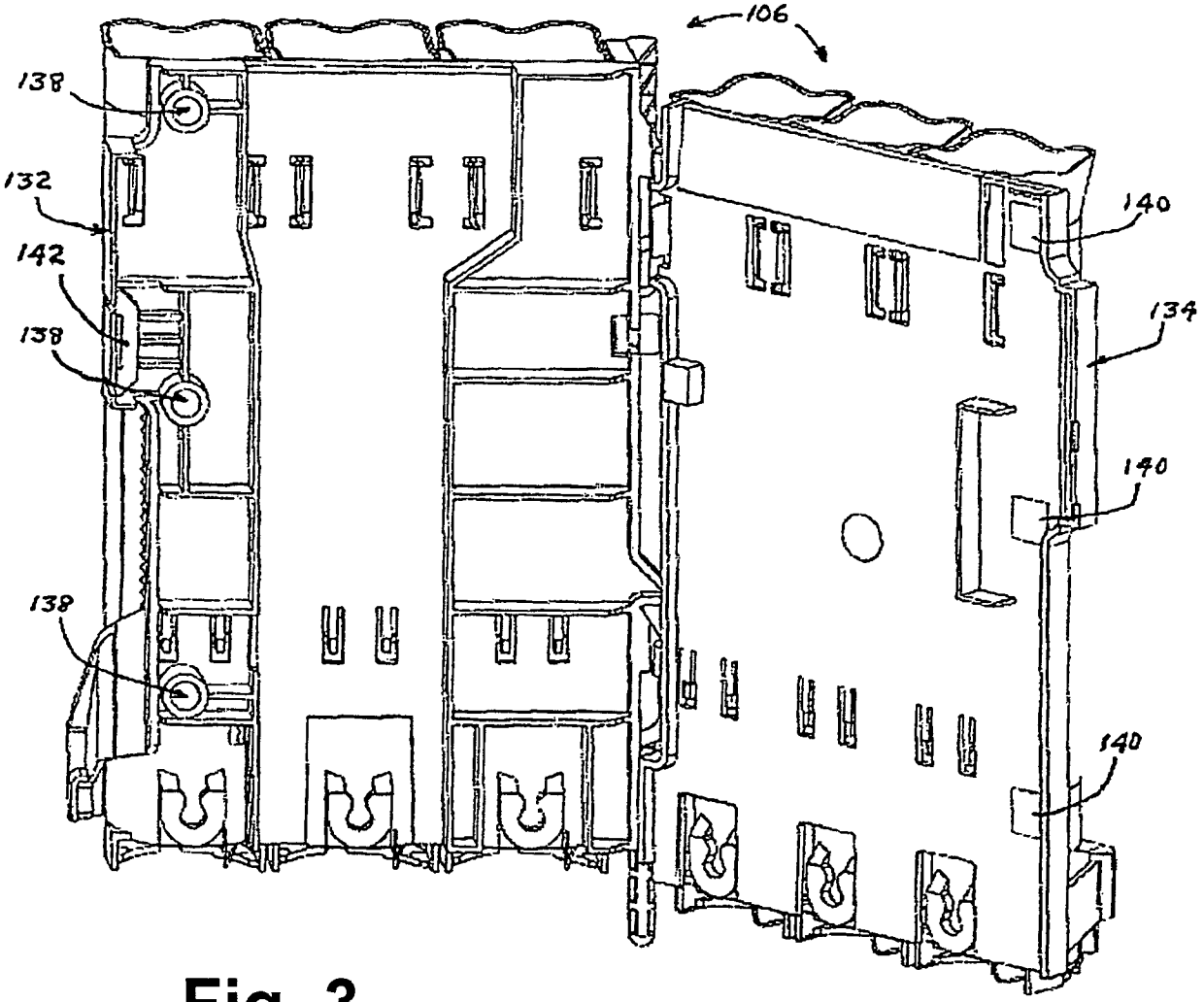
FIG. 3 is a perspective view of a cassette showing a light directing device according to an embodiment of the present invention.

Referring to FIG. 3, the coin cassette 106 comprises two supporting halves 132 and 134. In FIG. 3 the two supporting halves 132 and 134 are shown separated thereby revealing a light directing device 142. The light directing device 142 is preferably a prism. When the cassette 106 is in the operating position, the light directing device 142 directs a light beam from the aperture 107 through the light directing device 142 and back to the aperture 109 behind which a photo sensor is located. When the cassette 106 is not in the operating position, the light directing device 142 will not be in alignment with either or both of the apertures 107 and/or 109 and the light from the aperture 107 will not be directed back to the aperture 109 and the photo sensor. The light source 105 is turned on by a controller operating the coin changer when the optic path is interrupted. As a result, a light source 105 is automatically illuminated whenever a technician has removed the coin cassette 106. The light source 105 also provides an indication to a technician whether the two halves 132 and 134 have been properly aligned and configured with respect to one another and whether the cassette 106 has been properly and aligned and configured with respect to the changer housing 100.

The two supporting halves 132 and 134 of the cassette 106 are releasably fastened together by the magnets 138 and ferrous pieces 140 respectively connected thereto.

Figure 4:
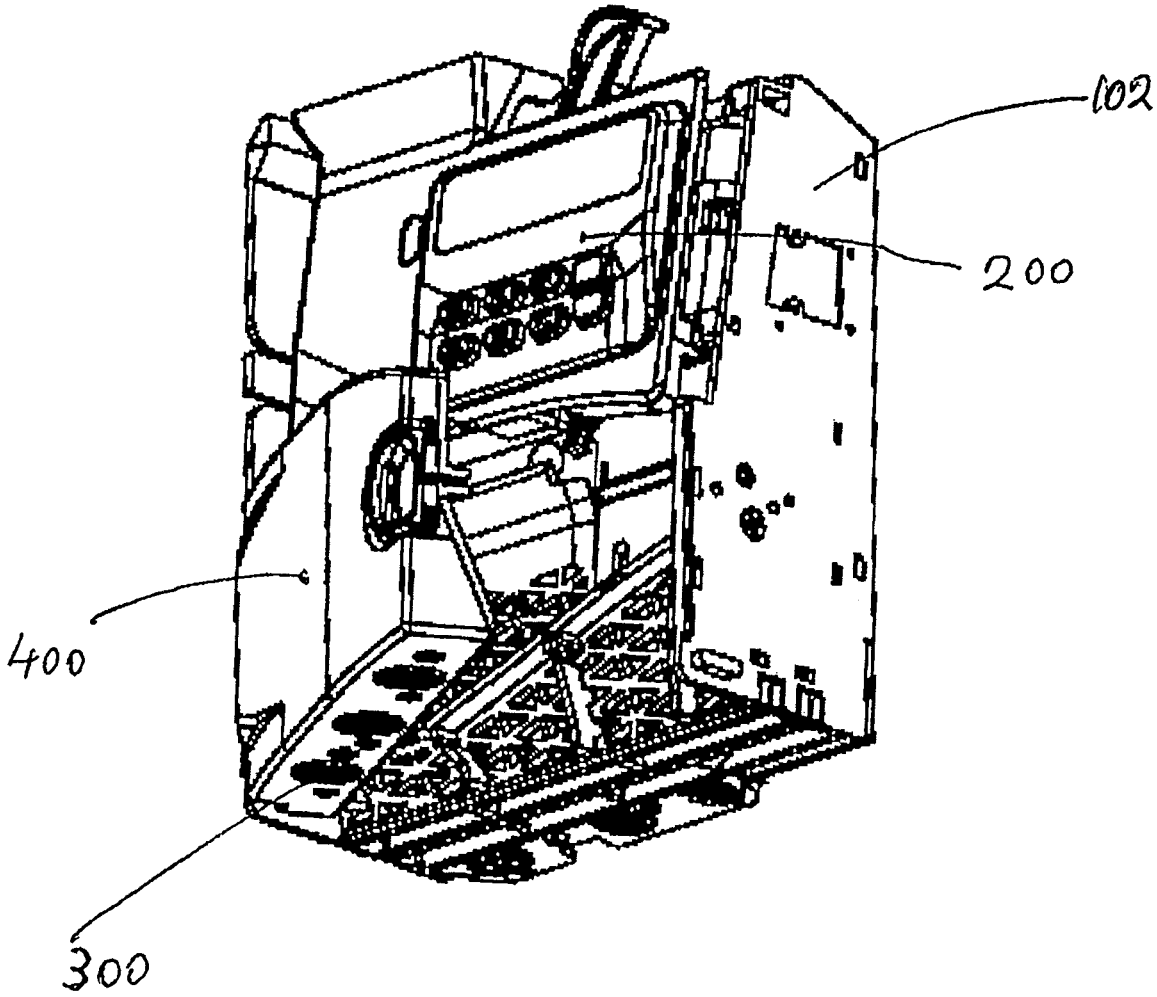
FIG. 4 is a perspective view of a coin changer acceptor module with the display and audible signal generator device according to an embodiment of the present invention.

FIG. 4 shows the acceptor portion 102 of the coin changer comprising a keypad-display module 200. When a sorting gate portion 400 is rotated, an audible signal generator 300 is visible. The audible signal generator 300 can be any known sound generating device, such as an electromagnetic speaker having a voice coil or a piezoelectric device. In the most preferred embodiment, the audible signal generator 300 can be used to provide an audible indication that the cassette 106 has been properly placed back in its operating position. It can also be used to provide a different audible indication upon the existence of an error and can also provide an audible indication of the type of error, such as through different tones or through different series of tones.

Figure 5:
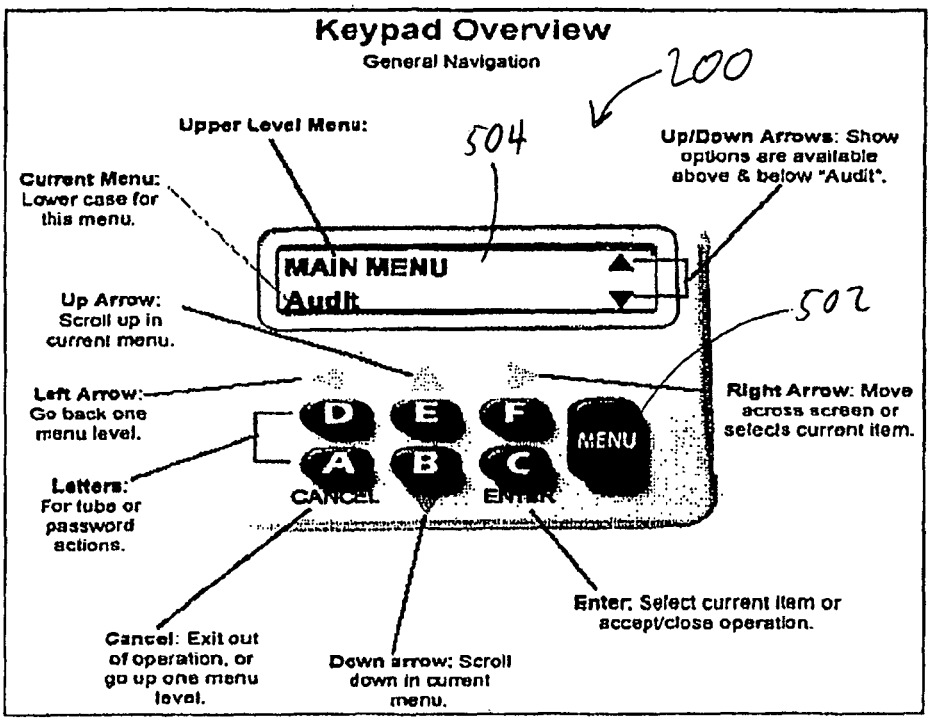
FIG. 5 is a diagram of a keypad for a coin changer according to an embodiment of the present invention.

FIG. 5 is a view of the keypad display module 200 showing the keypad controls 502 and the display 504. A user will activate the keys and use the display as a feedback to communicate instructions to the coin changer that configure its operation. For example, as shown in the flow chart of FIG. 6, using the keypad controls 502, the user can toggle the operation of the audible signal generator 300 to enable or disable audible sounds. Audible signals are generally considered useful, however, sometimes due to surrounding conditions a user may chose to disable audible sound.

Figure 7:
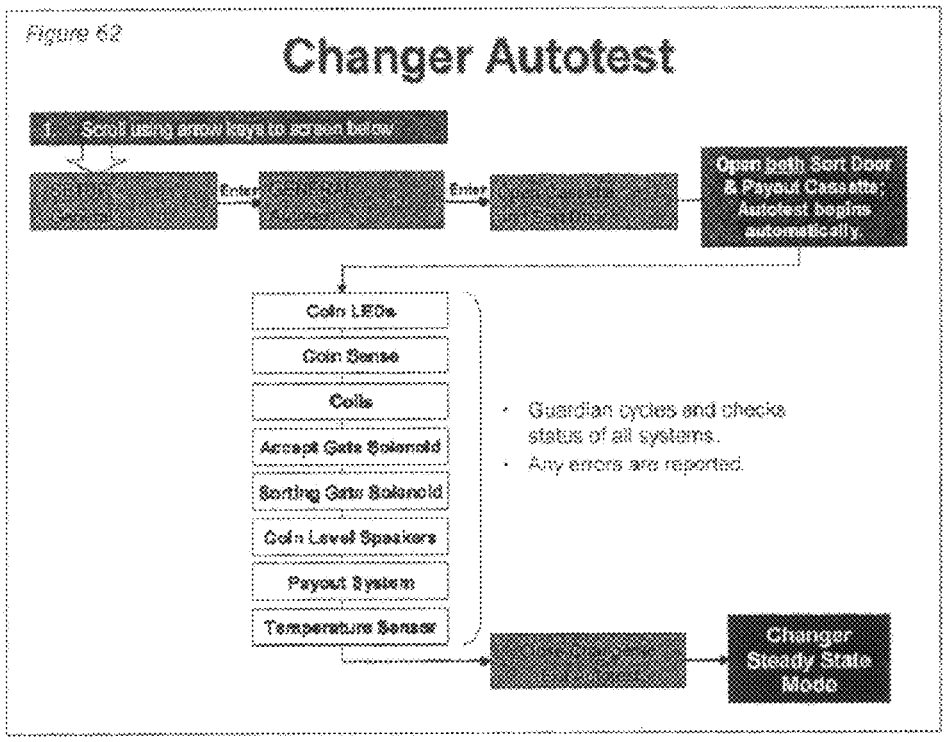
FIG. 7 is a flow chart showing steps for placing the coin changer in an autotest mode according to an embodiment of the present invention.

Audible and visual indications through the light source 105 and the audible signal generator 300 can also be implemented with autotest features of a coin changer. FIG. 7 shows the changer activity when the user selects the changer auto-test mode of operation. The user could select this mode of self diagnostic in which the changer will automatically move from test to test in steps with results of every step shown on the display 504. Other test modes could also be selected, e.g. one test at a time, when the changer will perform a self check of one feature only and wait for another command from the user.

FIG. 8 shows the "warning" and "out of service" messages that are displayed on the display portion of the keypad-display module 200. Other messages could also be introduce at a later time as user defined messages.

The coin changer of the preferred embodiment incorporates a range of features to assist the user. The coin storage cassette is illuminated when not in its operating position. When the cassette is attempted to be returned to the operating position, but is not sited properly, the illumination remains on and an audible sound is turned on to alert the user. The display shows the message "error" until the condition is removed. When the un-sited condition is removed, the sound and the illumination will be turned off, and the display will clear the message "error".

Other conditions may activate the audible and visual feedback to alert the user that the changer is in a non-ready state.

Figure 6:
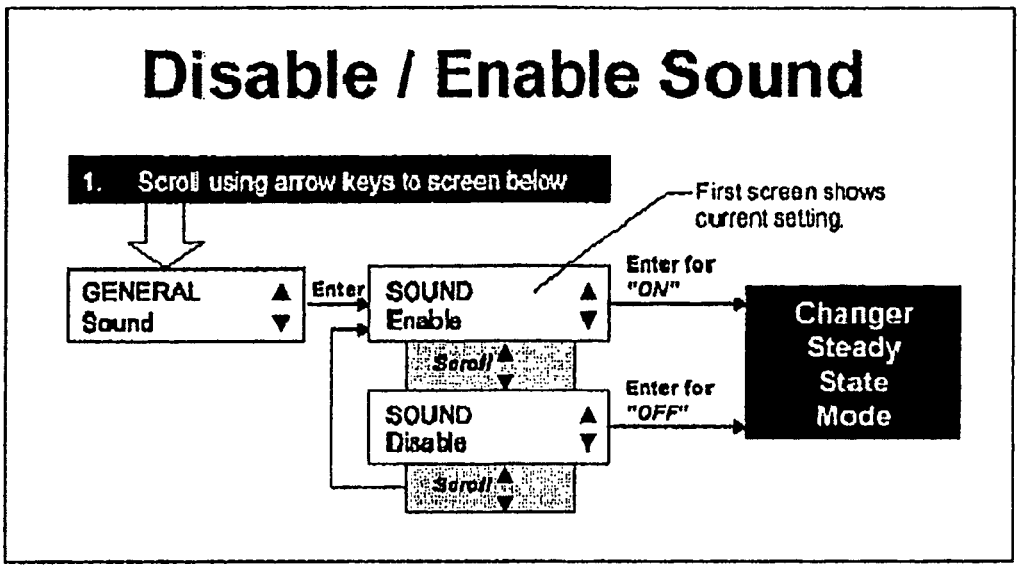
FIG. 6 is a flow chart showing steps required to enable or disable the audible signal generator according to an embodiment of the present invention.

Using the keypad controls 502 of the keypad-display module 200 of FIG. 5 and the sequence of entries as shown in the table of FIG. 7 the user could set up an auto-test mode of the changer. The changer enters a self diagnostic mode with multiple steps. The display portion of the keypad-display module reports the status of each of the steps. FIG. 8 shows the different types of messages possible. There are two types of messages: warnings, when the error is not essential and the changer remains functional and "out of service" if the error is critical and the changer is not operational. All warnings and out of service messages are accompanied by an audible beep and illumination from the cassette light source. In FIG. 6 a sequence of keys allows the user to enable or disable sound or illumination feedback.

The forgoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by the details of the embodiments presented in this description. The above specification, examples, and data provide a complete description of the manufacture and use of the invention. Many embodiments of the invention can be made without departing from the spirit and scope of the invention.

What is claimed is:

1. A coin changer indicating to a user that the coin changer is not in a ready state of operation comprising:

a coin changer housing including a cavity for selectively receiving a removable coin storage cassette;

the coin storage cassette having a plurality of coin stores and selectively positionable within the cavity of the housing in an operating position and selectively movable from the operating position to a non-operating position by a user;

a light source located within the housing that directs light onto the coin stores, the light source providing sufficient light to allow the user to substantially view the coin stores in the absence of another light source when the cassette is in the non-operating position; and an alignment structure that determines when the coin storage cassette is in the operating position and illuminates the light source when the coin storage cassette is in the non-operating position.

2. The coin changer of claim 1 wherein the alignment structure includes a second light source and a light indicator that are mounted within the coin changer housing such that when the cassette is in an operating position, a beam of light from the second light source reaches the indicator and when the cassette is not in an operating position, the beam of light cannot substantially reach the indicator.

3. The coin changer of claim 2 wherein the second light source and the light indicator are each located on the housing and are not located on the cassette.

4. The coin changer of claim 3 wherein the cassette includes a light directing device which, when the cassette is in the operating position, directs light from the second light source to the light indicator and when the cassette is not in the operating position, does not substantially direct light from the second light source to the light indicator.

5. The coin changer of claim 4 wherein the light directing device is a prism positioned on the cassette.

6. The coin changer of claim 1, further comprising an audible signal generator communicatively coupled to the alignment structure wherein the audible signal generator is adapted to generate an audible signal when the alignment structure determines the cassette is not in the operating position.

7. The coin changer of claim 1 wherein the alignment structure includes a second light source and a light indicator that are mounted within the coin changer housing and the cassette includes a light directing device which, when the cassette is in the operating position, directs light from the second light source to the light indicator and when the cassette is not in the operating position, does not substantially direct light from the second light source to the light indicator.

8. The coin changer of claim 7, further comprising an audible signal generator wherein the audible signal generator communicatively coupled to the alignment structure is adapted to generate an audible signal when the alignment structure determines the cassette is not in the operating position.

9. The coin changer of claim 1 wherein the cassette includes a first cassette portion and a second cassette portion each including one or more of the coin stores on opposing sides of the cassette, the first cassette portion being selectively couplable to the second cassette portion, wherein the alignment structure further determines when the first cassette portion is coupled in an aligned position with the second cassette portion and only illuminates the light source when it is determined that the first cassette portion is not aligned with respect to the second cassette portion.

10. The coin changer of claim 1 wherein the alignment structure includes a second light source and a light directing aperture associated with the housing cavity and a photo sensor and a light receiving aperture coupled to the photo sensor for transferring received light, the light directing aperture receiving aligning light from the second light source and directing the aligning light to a light directing device only when the cassette is in the operating position, the light directing device transmitting or redirecting the received aligning light from the light directing aperture to the light receiving aperture only when the cassette is in the operating position, the photo sensor providing the determining.

11. The coin changer of claim 1 wherein each of the coin stores of the cassette include transparent tubes for receiving a plurality of coins.

12. The coin changer of claim 1 wherein the cassette is selectively positionable within the housing cavity by one or more hinges, and wherein the cassette is selectively positionable between the operating position and the non-operating position by rotation about the hinges.

13. The coin changer of claim 12 wherein the alignment structure includes a second light source and a light directing aperture associated with the housing cavity and a photo sensor and a light receiving aperture coupled to the photo sensor for transferring received light, the light directing aperture receiving aligning light from the second light source and directing the aligning light to a light directing device only when the cassette is rotated about the hinges into the operating position, the light directing device transmitting or redirecting the received aligning light from the light directing aperture to the light receiving aperture only when the cassette is in the operating position, the photo sensor providing the determining.

14. The coin changer of claim 13 wherein the cassette includes a first cassette portion and a second cassette portion each including one or more of the coin stores on opposing sides of the cassette, the first cassette portion being selectively couplable to the second cassette portion, wherein the alignment structure further determines when the first cassette portion is coupled in an aligned position with respect to the second cassette portion and illuminates the light source when it is determined that the first cassette portion is not aligned with respect to the second cassette portion.

15. The coin changer of claim 14, further comprising an audible signal generator wherein the audible signal generator communicatively coupled to the alignment structure is adapted to generate an audible signal when the alignment structure determines either that the cassette is not in the operating position or the first cassette portion is not aligned with respect to the second cassette portion.

16. A coin changer indicating to a user that the coin changer is not in a ready state of operation comprising:

a coin changer housing including a cavity for selectively receiving a removable coin storage cassette;

the coin storage cassette having a plurality of coin stores and selectively positionable within the cavity of the housing in an operating position and selectively movable from the operating position to a non-operating position by a user;

a light source located within the housing that directs light onto the coin stores, the light source providing sufficient light to allow the user to substantially view the coin stores in the absence of another light source when the cassette is in the non-operating position; and an alignment structure that determines when the coin storage cassette is in the operating position and illuminates the light source when the coin storage cassette is in the non-operating position, the alignment structure having a second light source and a light indicator that are mounted within the coin changer housing and the cassette includes a light directing device receiving aligning light from the second light source and providing received aligning light to the light indicator when the cassette is in an operating position, a beam of light from the second light source not being received by the light directing device or provided to the light indicator when the cassette is in the non-operating position.

17. The coin changer of claim 16 wherein the cassette includes a first cassette portion and a second cassette portion each including one or more of the coin stores on opposing sides of the cassette, the first cassette portion being selectively couplable to the second cassette portion, wherein the alignment structure further determines when the first cassette portion is coupled in an aligned position with respect to the second cassette portion and illuminates the light source when it is determined that the first cassette portion is not aligned with respect to the second cassette portion.

18. The coin changer of claim 17, further comprising an audible signal generator wherein the audible signal generator communicatively coupled to the alignment structure is adapted to generate an audible signal when the alignment structure determines either that the cassette is not in the operating position or the first cassette portion is not aligned with respect to the second cassette portion.

* * * * *